US010655626B2

(12) United States Patent
Knight et al.

(10) Patent No.: US 10,655,626 B2
(45) Date of Patent: May 19, 2020

(54) LIQUID RING PUMP

(71) Applicant: Edwards Limited, Burgess Hill, West Sussex (GB)

(72) Inventors: Gary Peter Knight, Clevedon (GB); Andrew James Seeley, Clevedon (GB); Geoffrey Young, Clevedon (GB); Duncan Michael Price, Clevedon (GB)

(73) Assignee: Edwards Limited, Burgess Hill, West Sussex (GB)

( * ) Notice: Subject to any disclaimer, the term of this patent is extended or adjusted under 35 U.S.C. 154(b) by 313 days.

(21) Appl. No.: 15/745,619

(22) PCT Filed: Jun. 15, 2016

(86) PCT No.: PCT/GB2016/051761
§ 371 (c)(1),
(2) Date: Jan. 17, 2018

(87) PCT Pub. No.: WO2017/013380
PCT Pub. Date: Jan. 26, 2017

(65) Prior Publication Data

US 2018/0209420 A1 Jul. 26, 2018

(30) Foreign Application Priority Data

Jul. 22, 2015 (GB) ..... 1512897.8

(51) Int. Cl.
*F04C 19/00* (2006.01)
*F04C 25/00* (2006.01)
(Continued)

(52) U.S. Cl.
CPC ..... *F04C 19/005* (2013.01); *F04C 19/00* (2013.01); *F04C 19/004* (2013.01); *F04C 25/00* (2013.01);
(Continued)

(58) Field of Classification Search
CPC ..... F04C 19/00; F04C 19/004
See application file for complete search history.

(56) References Cited

U.S. PATENT DOCUMENTS 3,108,738 A * 10/1963 Luhmann ..... F04C 19/004 417/68
3,588,283 A 6/1971 Fitch
(Continued)

FOREIGN PATENT DOCUMENTS

CN 101155634 A 4/2008
CN 201678617 U 12/2010
(Continued)

OTHER PUBLICATIONS

British Search Report dated Jan. 27, 2016 and Examination Report dated Jan. 28, 2016 for corresponding British Application Serial No. GB1512897.8.
(Continued)

*Primary Examiner* — Patrick Hamo
(74) *Attorney, Agent, or Firm* — Westman, Champlin & Koehler, P.A.; Theodore M. Magee

(57) ABSTRACT

Liquid ring pumps are used to pump a variety of fluid types. Corrosive fluids are easily handled by the work fluid but can cause corrosion of pumping mechanisms. The present invention provides a magnetically driven liquid ring pump with corrosion resistant pumping mechanisms which achieves a longer time between service intervals.

15 Claims, 8 Drawing Sheets

(51) Int. Cl.
*F04C 29/00* (2006.01)
*F04C 29/02* (2006.01)

(52) U.S. Cl.
CPC ..... *F04C 29/0085* (2013.01); *F04C 29/02* (2013.01); *F04C 2280/04* (2013.01)

(56) References Cited

U.S. PATENT DOCUMENTS

| | | | | |
|---|---|---|---|---|
| 3,846,046 | A | 11/1974 | Roe et al. | |
| 4,050,851 | A * | 9/1977 | Haavik | F04C 19/004 417/68 |
| 6,347,926 | B1 * | 2/2002 | Pyrhonen | F01C 7/00 417/356 |
| 9,689,387 | B2 * | 6/2017 | Shenoi | F04C 19/007 |
| 2001/0026759 | A1 | 10/2001 | Kraner | |
| 2009/0202411 | A1 | 8/2009 | Smith et al. | |
| 2010/0024654 | A1 | 2/2010 | Shaw et al. | |
| 2010/0101414 | A1 | 4/2010 | Smith et al. | |
| 2015/0136027 | A1 | 5/2015 | Hara et al. | |

FOREIGN PATENT DOCUMENTS

| | | | |
|---|---|---|---|
| CN | 104074775 | A | 10/2014 |
| DE | 2912938 | A1 | 10/1980 |
| DE | 3513348 | A1 | 10/1986 |
| DE | 29619930 | U1 | 4/1998 |
| JP | S5879687 | A | 5/1983 |
| WO | 2006008521 | A1 | 1/2006 |
| WO | 2017013383 | A1 | 1/2017 |

OTHER PUBLICATIONS

PCT International Search Report and Written Opinion dated Oct. 6, 2016 for corresponding PCT Application Serial No. PCT/GB2016/051761.

British Search Report dated Jan. 28, 2016 and Examination Report dated Jan. 29, 2016 for corresponding British Serial No. GB1512902.6.

PCT International Search Report and Written Opinion dated Sep. 9, 2016 for corresponding PCT Application No. PCT/GB2016/051764.

First Office Action dated Nov. 2, 2018 and Search Report dated Oct. 26, 2018 for corresponding Chinese Application No. CN201680042944.2.

Communication dated Oct. 29, 2018 for corresponding European Application Serial No. 16731259.4-1004.

Prosecution history for related U.S. Appl. No. 15/746,266 including: Office Action dated Apr. 26, 2019; Response dated Jul. 25, 2019 and Office Action dated Nov. 4, 2019.

* cited by examiner

LIQUID RING PUMP

CROSS-REFERENCE OF RELATED APPLICATION

This application is a Section 371 National Stage Application of International Application No. PCT/GB2016/051761, filed Jun. 15, 2016, which is incorporated by reference in its entirety and published as WO 2017/013380 A1 on Jan. 26, 2017 and which claims priority of British Application No. 1512897.8, filed Jul. 22, 2015.

FIELD

Embodiments relate to a liquid ring pump and a method of operating said liquid ring pump. In particular, the embodiments relate to a liquid ring pump for pumping and treating a corrosive effluent gas stream from a processing chamber at least one constituent of which is reactive with or soluble in a service liquid of the pump.

BACKGROUND

Liquid ring pumps are used to pump a variety of gases, however their typical materials of construction (e.g. stainless steel, cast iron, brass, etc.) precludes their long term use with strongly corrosive or reactive gases (i.e. acidic, basic, oxidising or reducing gases). Known liquid ring pumps have been made from exotic materials such titanium, ceramics and polymers, however, not only can these materials be costly but it is difficult to manufacture pumps in these materials with the required close dimensional tolerances between certain components, for example the rotor and the stator.

During the evacuation of some semiconductor manufacturing processes, for example plasma etch, the effluent gas stream produced is chemically reactive with, or soluble in, the service liquid (typically water) in the liquid ring pump. This generates a corrosive service liquid and thus corrosion products from the reaction of said corrosive service liquid with the internal workings of the pump. Such corrosion products can cause additional corrosion and abrasion within the pumping arrangement.

The discussion above is merely provided for general background information and is not intended to be used as an aid in determining the scope of the claimed subject matter. The claimed subject matter is not limited to implementations that solve any or all disadvantages noted in the background.

SUMMARY

Embodiments seek at least to mitigate one or more of the problems associated with the prior liquid ring pumps.

A liquid ring pump for treating a corrosive effluent gas stream from a processing chamber which is reactive with, or soluble in, a service liquid of the pump to form corrosion products, the pump comprising: an annular pumping chamber which is generally cylindrical around a central pumping chamber axis for receiving the gas stream and a service liquid; a rotor having a rotor axis which is offset from the central pumping chamber axis, the rotor having a plurality of rotor blades which, on rotation of the rotor, cause liquid in the pumping chamber to form a ring having a centre coincident with the central axis of the pumping chamber and compression of effluent gas conveyed from an inlet to an outlet of the pumping chamber; a magnetic drive assembly for driving the rotor, the magnetic drive assembly comprising a magnetic follower received in a drive chamber that can be magnetically coupled with a magnetic drive outside the drive chamber such that when the magnetic drive is driven by a motor the magnetic follower imparts rotation to the rotor; wherein the drive chamber is in fluid communication with the pumping chamber allowing circulation of the service liquid in the drive chamber and the pumping chamber, and wherein the pumping chamber, drive chamber, magnetic follower and rotor comprise one or more materials which are resistant to the effluent gas stream and the corrosion products generated when the gas stream is treated by the service liquid.

Other preferred and/or optional aspects of the invention are defined in the accompanying claims.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

In order that the embodiments may be well understood, an embodiment thereof, which is given by way of example only, will now be described with reference to the accompanying drawings, in which.

DESCRIPTION OF THE EMBODIMENTS

Figure 1:
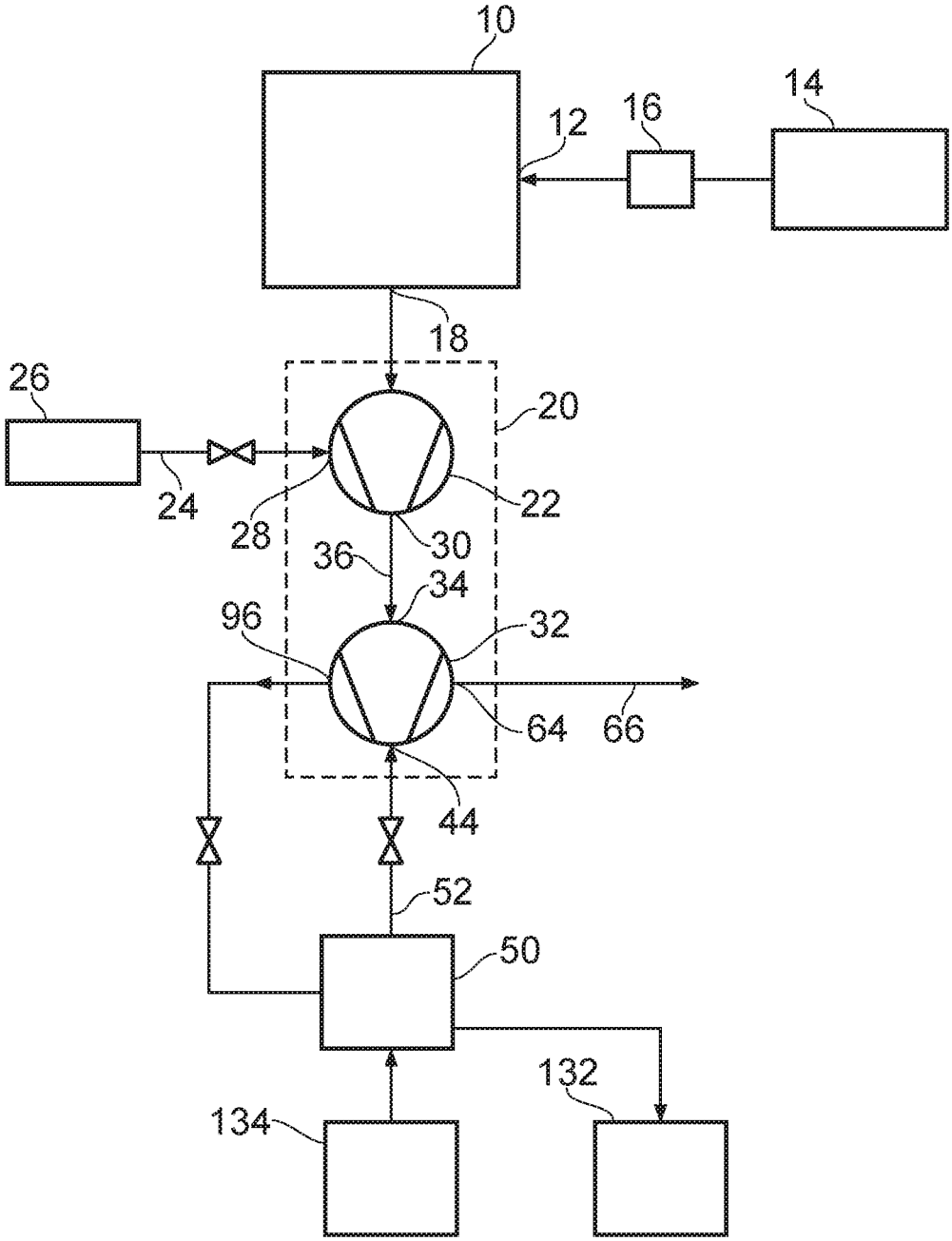
FIG. 1 illustrates schematically a system for evacuating a process chamber.

With reference first to FIG. 1, a process chamber 10 is provided with at least one inlet 12 for receiving one or more process gases from gas sources indicated generally at 14. The process chamber 10 may, for example, be a chamber within which the processing of semiconductors or flat panel display devices takes place. A mass flow controller 16 may be provided for each respective process gas, the mass flow controllers being controlled by a system controller (not shown) to ensure that the required amount of gas is supplied to the process chamber 10.

A waste gas stream is drawn from the outlet 18 of the process chamber 10 by a pumping system indicated at 20 in FIG. 1. During the processing conducted within the chamber 10, only a portion of the process gases supplied to the chamber will be consumed, and so the waste gas stream exhaust from the outlet 18 of the process chamber 10 will contain a mixture of the process gases supplied to the chamber 10, and by-products from the process conducted within the chamber 10.

The pumping system 20 comprises a first pumping arrangement 22. The first pumping arrangement 22 comprises a multi-stage dry pump, wherein each pumping stage of said pump may be provided by a Roots-type or Northeytype pumping mechanism. The first pumping arrangement may also comprise a turbomolecular pump, and/or a molecular drag mechanism, and/or a mechanical booster pump, such as a roots blower, depending on the pumping requirements of the process chamber 10. One pump is shown in the first pumping arrangement 22 of FIG. 1, although any suitable number may be provided depending on the capacity of the process chamber 10. To prevent the pump(s) of the first pumping arrangement 22 from becoming damaged during evacuation of the process chamber 10, as illustrated in FIG. 1, a purge gas such as nitrogen or helium may be supplied to a pump of the pumping arrangement 22 via a conduit system 24 connecting a source 26 of the purge gas with a purge port 28 of a pump of the first pumping arrangement 22.

The first pumping arrangement 22 draws the waste gas stream from the outlet 18 of the process chamber 10 and exhausts the gas stream at a pressure, typically in the range from 50 to 1000 mbar, from an exhaust 30 thereof. It has been found advantageous for the pumping system 20 to also include a liquid ring pump (LRP) backing pump 32 having a first inlet 34 connected to the exhaust 30 of the first pumping arrangement 22 via a conduit system 36.

Depending on the process conducted within the process chamber 10, the waste stream entering the liquid ring pump 32 may contain one or more halogen-containing and/or silicon-containing gases used as a precursor in the manufacture of a semiconductor device. Examples of such gases and their process by-products include tetrafluoromethane; fluorine; hydrogen fluoride; silane; disilane; dichlorosilane; trichlorosilane; tetraethylorthosilicate (TEOS); a siloxane, such as octamethylcyclotetrasiloxane (OMCTS); and an organosilane.

In view of these types of gases, the liquid ring pump 32 is able to perform as both a wet scrubber for the waste gas stream whilst also compressing the gas stream for exhausting to atmosphere (and thus reducing the exhaust pressure of the first pumping arrangement 22 such that its overall power usage is reduced). The liquid ring pump 32 may also act as a backing pump if the first pumping arrangement only comprises a turbomolecular pump, and/or a molecular drag mechanism, and/or a mechanical booster pump.

Figure 2:
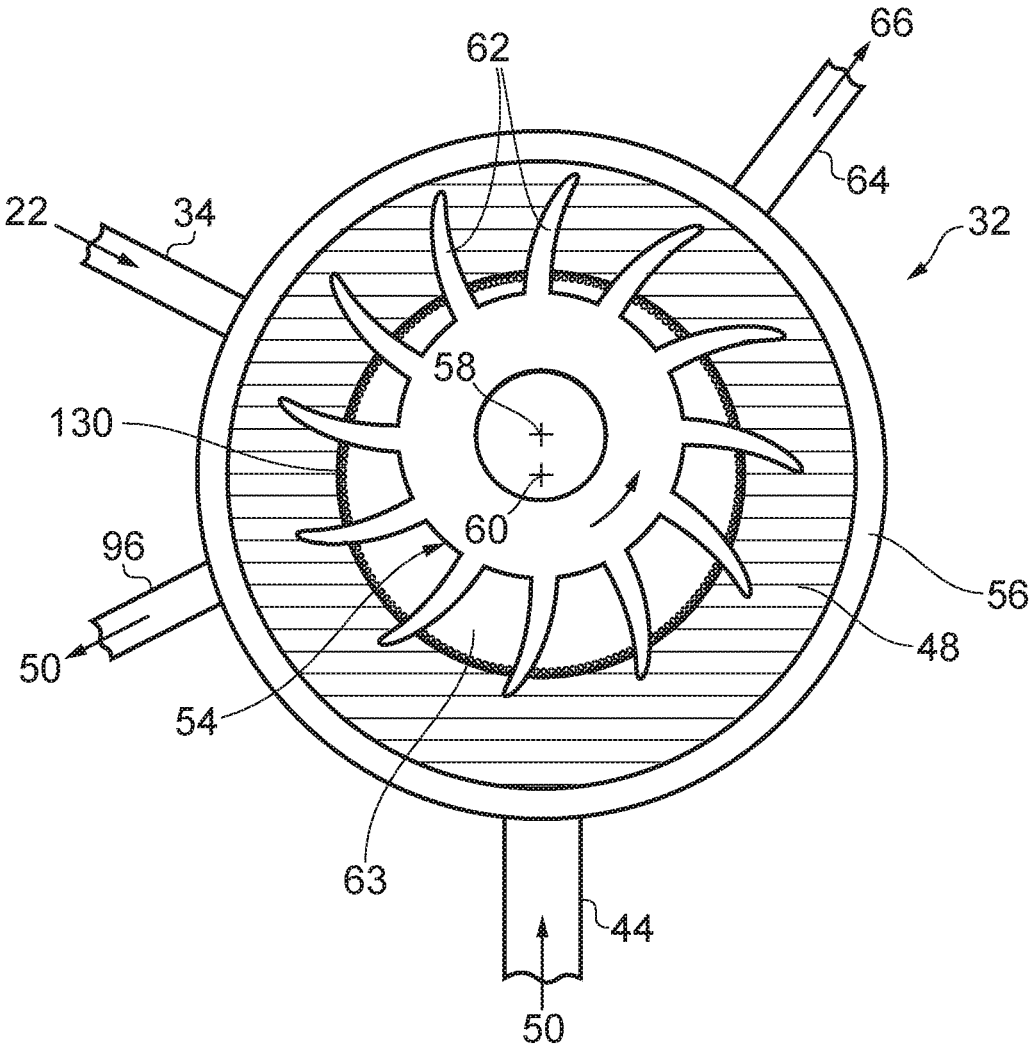
FIG. 2 illustrates schematically one embodiment of an apparatus for treating a gas stream drawn from the process chamber.

Referring to FIGS. 1 and 2 the waste gas stream enters the liquid ring pump 32 through inlet 34. A second inlet 44 conveys liquid from a liquid control 50 via conduit system 52 for forming a liquid ring 48 within the pump 32. A service liquid source 134 replenishes lost liquid from the pump. In this embodiment, the liquid is water, although any other aqueous solution or suitable solvent, may be used. Liquid drained from the pump is directed by the liquid control 50 to a disposal or treatment unit 132.

As illustrated in FIG. 2, the liquid ring pump 32 comprises a rotor 54 rotatably mounted in an annular pumping chamber 56 such that the rotor axis 58 is eccentric to the central axis 60 of the chamber 56. The rotor 54 has a rotor hub 61 and a plurality of blades 62 that extend radially outwardly therefrom and are equally spaced around the rotor 54. With rotation of the rotor 54, the blades 62 engage the liquid and form it into an annular ring 48 inside the chamber 56.

This means that on an inlet side of the pump 32 the gas present in the compression regions located between adjacent rotor blades 62 is moving radially outward, away from the rotor hub, while on the outlet side of the pump the gas is moving radially inward toward the rotor hub. This results in a piston-type pumping action on the gas passing through the pump 32.

The waste stream entering the liquid ring pump 32 through the first inlet 34 is pulled into the spaces 63 between adjacent blades 62. The gas stream is compressed by the piston-type pumping action and exhausted through an exhaust 64 on the outlet side thereof for exhausting from the pump 32 a treated gas stream predominantly containing treated gas but also some liquid from the liquid ring 48. The service liquid becomes contaminated with corrosion products, or particulates produced by treatment of the gas stream and over time the liquid may become less effective at treating the gas or may become too corrosive or abrasive. It is necessary therefore to remove liquid from the pump and replenish the pump with fresh service liquid. The rate at which liquid is replenished is dependent on a number of factors, for example, the reactivity or solubility rate of the particular component of the effluent gas stream with the service liquid. Liquid drained from the pump may subsequently be treated to remove corrosion products and/or particulates and re-used or simply disposed of. Liquid is drained from the pump through drain port 96, described in more detail below, and fresh liquid enters the pump through inlet 44.

Figure 3:
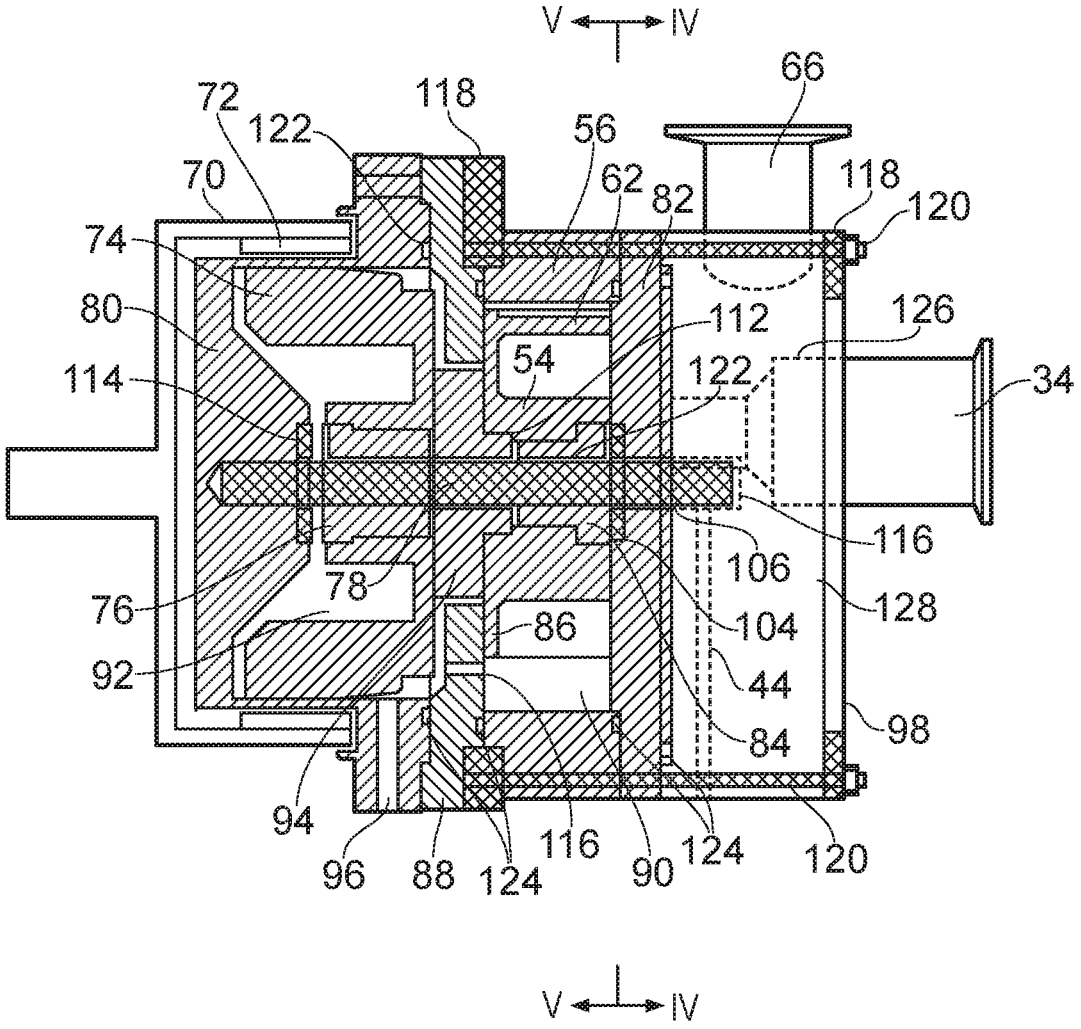
FIG. 3 shows a section through a liquid ring pump.

A cross-section through a liquid ring pump 32 is shown in FIG. 3. The pump comprises a magnetic drive assembly for driving the rotor 54. The drive assembly comprises a magnetic follower 74, received in a drive chamber 92, and magnetically coupled to a magnetic drive 70 external to the drive chamber 92. The magnetic drive 70 comprises a drive magnet 72. In use, a motor (not shown) imparts rotation to the magnetic drive 70 and drive magnet 72 which drives the magnetic follower 74. Accordingly, torque is transferred from the motor to the rotor 54 in the pumping chamber 90 by means of a magnetic drive coupling. This arrangement avoids the need for rotating shaft seals significantly reducing the risk of leakage.

The magnetic follower 74 is fixed to a first bearing 76 which is supported for rotation by a stationary cantilevered shaft 78 fixed to a magnetic drive housing 80. An opposing end of the shaft 78 extends through a port plate 82 and is therefore retained with a central shaft axis along the eccentric axis 58 of the pump. The rotor 54 is fixed to a second bearing 84 which is supported for rotation by shaft 78. A drive piece 94 connects the magnetic follower 74 to the rotor so that rotation of the motor is transmitted to the rotor. The rotor blades 62 extend outwardly from the rotor hub and are supported at one end by a circumferential portion 86. The shaft 78 extends through an adapter plate 88 between the rotor and the follower magnet. A stator 56, which in this example is part of the pump housing, forms the pumping chamber 90 with the adapter plate 88 and the drive piece 94. The magnetic drive housing 80 together with the adapter plate 88 and the drive piece 94 forms a drive chamber 92. The adapter plate therefore generally separates the pumping chamber 90 from the drive chamber 92.

A head plate 98 comprises waste stream gas inlet 34 and outlet 66 together with liquid inlet 44. A liquid outlet 96 from the pump extends from the drive chamber 92 through the drive housing 80. The head plate 98 co-operates with the port plate 82 which conveys gas into and out of the pumping chamber and service liquid into drive and pumping chambers. The inlet 34 conveys gas along a conduit 126 formed through the head plate. The head plate further comprises an internal chamber 128 which communicates with the outlet 66.

Figure 4:
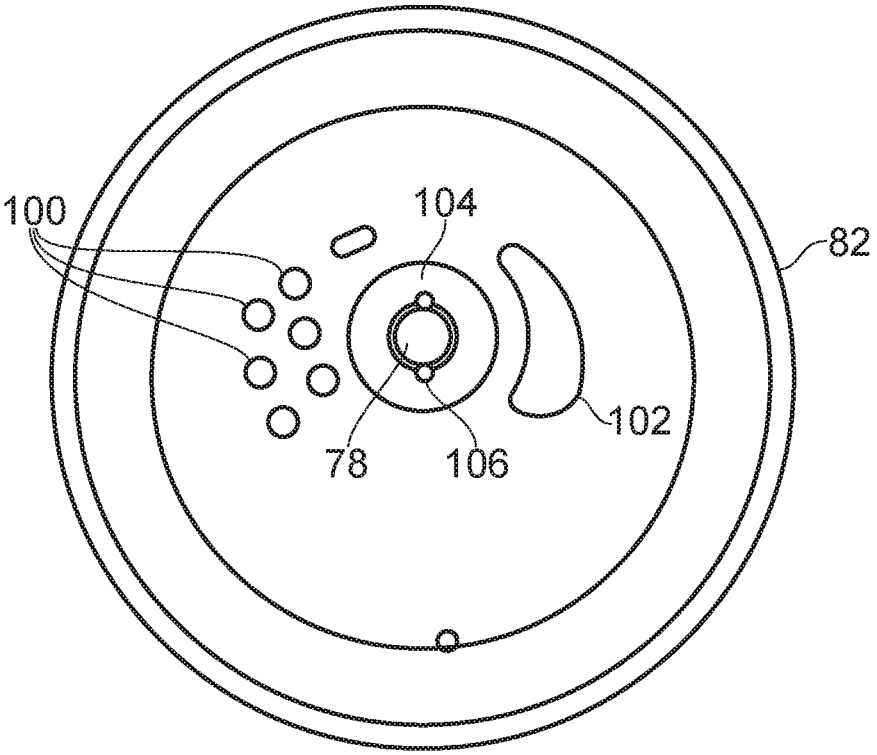
FIG. 4 shows a section taken along line IV-IV in FIG. 3.
Figure 5:
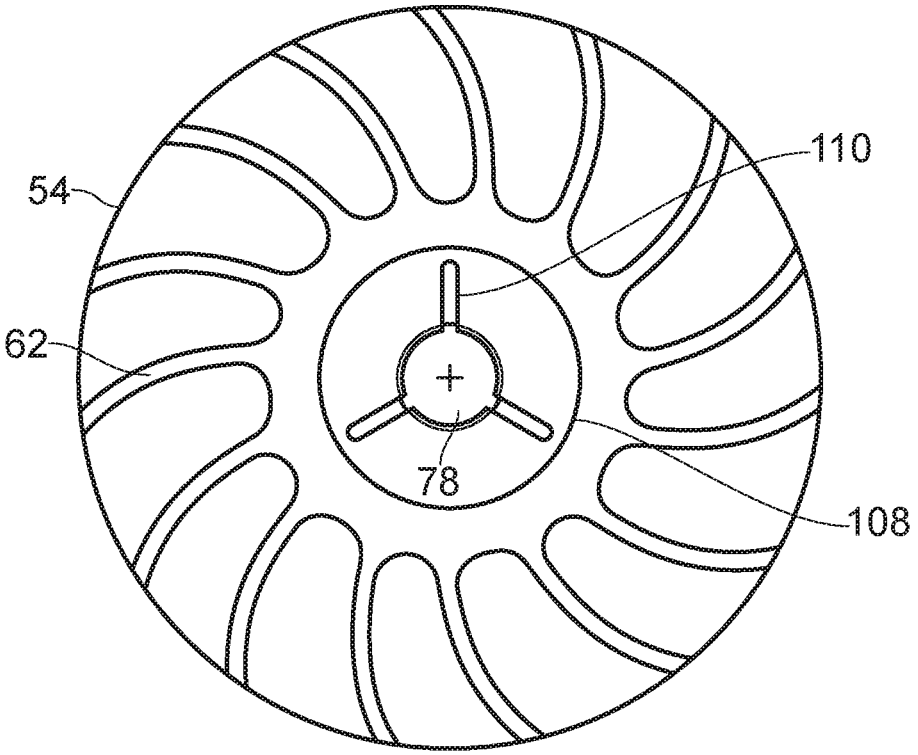
FIG. 5 shows a section taken along line V-V in FIG. 3.

The port plate 82 can be seen in more detail in FIG. 4 which is a section through the pump taken along line IV-IV in FIG. 3. The gas inlet 34 conveys gas along conduit 126 to an inlet aperture 102 which passes through the port plate 82 into the pumping chamber 90. A plurality of outlet apertures 100 pass through the port plate and convey gas from the pumping chamber 90 through the internal chamber 128 to be exhausted through the gas outlet 66. A central portion of the port plate 82 has a circular recess for receiving a thrust plate 104. The thrust plate 104 has a central hole through which the shaft 78 extends. The thrust plate 104 and the port plate 82 further comprise a plurality of channels 106 along which service liquid can flow for lubricating the shaft. The thrust plate 104 axially extends from the port plate so that sits proud of the planar surface of the port plate and defines the minimum axial spacing between the rotor 54 and the port plate. The axial extension/height of the thrust washer 104 above the surface of the port plate determines the clearance. The thrust plate 104 co-operates with thrust surface 108 of the second bearing 84 and can be seen in more detail in FIG. 5 which is a section through the pump taken along line V-V in FIG. 3.

The thrust surface of the bearing 108 has three engraved blind-ending radial liquid distribution channels 110, that are located flush to the bearing surface. By suitable axial alignment of the magnetic drive coupling 72, 74, a forward, axial, thrust (to the right in FIG. 2) is transmitted to the second bearing so that the bearing thrust surface 108 is held relative to the thrust plate 104 located in the port plate 82. Service liquid pressure in the distribution channels 110 forms a hydrodynamic bearing between second bearing 84 and thrust plate 104 allowing a non-contact bearing for supporting rotation of the impeller 54 at an accurate axial clearance from the port plate 82. No springs are required and fine adjustment of the force may be achieved by the use of shims 112 inserted along the shaft 78.

A rear thrust plate 114 may mounted in a circular recess of the drive housing 80 and adapted to extend axially and sit proud of the internal surface of drive housing 80 to protect the magnetic drive should an axial force move the follower magnet to the left as shown in FIG. 2.

Liquid entering the pump is directed along inlet 44 to a central chamber 116 in the port plate which surrounds an axial end of the shaft 78. The central chamber 116 fluidly communicates with the channels 106 in the port plate 82 and thrust plate 104 so that liquid entering the pump is directed along the shaft 78 for lubrication and flushing the interface between the shaft 78 and the rotating components 76, 94, 84 of the pump. The rotating components are shaped along the interface with the shaft 78 to extend the channels 106 along the shaft to the drive chamber 92 to ensure that the full axial and circumferential extent of the shaft is lubricated. The channels 106 convey water along the shaft and by rotation of bearings 84, 76 and the drive piece 94 cause the service liquid (for example water) to flush the circumferential surface of the shaft with clean water thereby removing any particulates along the shaft downstream. The service liquid, having completed its lubrication duty, exits the rear of the first bearing 76 and passes into the pumping chamber 90 through a conduit defined by the gap between the adaptor plate 88 and the drive piece 94. Additional service liquid (possibly recirculated service liquid) can be supplied by other suitably located ports.

An additional suitably sized port 117 extends through the adaptor plate 88 and allows liquid to pass between the drive chamber 92 and pumping chamber 90 thereby acting as a pressure relief for the service liquid between the magnetic drive housing and the pump chamber. The location and size of this port is selected to optimise flow of service liquid in the pumping chamber to improve pumping performance.

The pump comprises a plurality of discrete components which are assembled and held together using external steel support rings 118 which spread the compression and are fixed by a plurality of tie bars 120. This arrangement provides mechanical stiffness and facilitates both axial and radial location and orientation. Sealing of the components is achieved using O-rings 122 set into channels 124 formed in the faces of each component. Moreover, the components of the pump can readily be changed to allow performance modification for different pumping and abatement requirements. For example, the stator 56 defining the pumping chamber is a discrete component which allows different radial profiles and sizes to be used so as to optimise pump performance by controlling the radial clearances between the impeller 54 and the stator 56. The pumping capacity of the liquid ring pump may also be adjusted by changing the axial length of the stator 56, impeller 54 and shaft 78 without having to redesign any other components of the pump.

The materials from which the components of the pump are made are selected to be corrosion resistant to afford good corrosion resistance to a wide range of aggressive substances which may be encountered in the effluent gas stream exhausted from the processing chamber. The drive shaft 78 and thrust washers 104, 114 may be made from high purity alumina, sintered silicon carbide or other similar materials. The first bearing 76 for the magnetic drive 74 and the second bearing 84 for the impeller 54 are selected from a range of self-lubricating materials such as (but not limited to), graphite and graphite/PTFE composites. The mag-drive housing 80, adaptor plate 88, pumping chamber stator 56, port plate 82, head plate 98 and impeller 54 may be manufactured from a range of polymers such as (but not limited to) poly(vinyl chloride), filled polypropylene, poly(phenylene sulphide), poly(vinylidene fluoride); these may also comprise PTFE.

The liquid ring pump has been optimised with treatment of effluent gas streams in mind. In this regard, the liquid ring pump is adapted to be installed in a vertical orientation with the shaft extending generally vertically. It is noted that conventional liquid ring pumps have traditionally been horizontally mounted. Vertically mounting the pump allows the pump inlet 34 to be both parallel to the axis and vertical. Thus particle laden gas streams from a process chamber have an uninterrupted path into the pumping chamber 90, minimising the chances of blockage (for example in conduit 36). Further opportunity for blockage is reduced by use of a specifically designed inlet system fed with service liquid ported directly, under pressure, from the liquid ring to flush the inlet path.

Vertical mounting of the liquid ring pump also significantly reduces its footprint. The use of an exhaust port 66 perpendicular to the shaft axis (horizontal to the ground) allows very close coupling of a gas/liquid separator tank further improving the pumping packaging and reducing the footprint.

Use of the liquid ring pump will now be described in further detail.

The motor of the pump (not shown) is activated causing the magnetic driver 70 and thus the drive magnets 72 to rotate around an eccentric axis 58 of the pump. Through magnetic coupling the magnetic follower 74 is caused to rotate which transmits torque through the drive piece 94 to the impeller/rotor 54. Service liquid, such as water, is introduced from the control 50 through liquid inlet 44 of the liquid ring pump and passes along the shaft 78 providing lubrication and into the drive chamber 92. From the drive chamber, liquid passes into the pumping chamber 90 through the gap or conduit formed between the drive piece 94 and the adaptor plate 88. Rotation of the rotor 54 causes the liquid to form a ring in pumping chamber 90 having an axial length of approximately the length of the stator 56. FIG. 2 shows the pumping chamber 90 in this state of operation. An effluent gas stream pumped from the processing chamber 10 by the first pumping arrangement 22 is introduced to the pumping chamber 90 of the liquid ring pump 32 through inlet 34, conduit 126 and through the inlet aperture 102 in the port plate 82. The gas undergoes compression and wet scrubbing in the pumping chamber 90. In this latter regard, the interface layer between the service liquid and the gas forms a foam 130 which increases the surface area of the liquid available for scrubbing the gas. The gas stream is exhausted from the pumping chamber 90 through outlet apertures 100, through internal chamber 128 and gas outlet 66. The concentration of corrosive products in the service liquid will increase during operation as more corrosive gases are passed to the pump 32. Service liquid is drained from the pump through liquid outlet 96 and conveyed for abatement or disposal in unit 132 (FIG. 1). Additional clean service liquid is introduced from a source 134 into the pump along inlet 44.

When scrubbing certain corrosive gases it is desirable to control the amount of service liquid which enters the pump in order to control the temperature of the service liquid. That is, the pump 32 generates heat during operation which is exchanged with the service liquid. If the amount (total volume or replenishment flow rate) of service liquid present in the pump is reduced the service liquid rises to a higher temperature. Conversely, if more liquid is present (total volume or replenishment flow rate) the temperature of the service liquid is reduced. Accordingly, control 50 controls the amount of liquid in the pump dependent on the constituents of the effluent gas so that the liquid temperature is suited to scrubbing those constituents.

For example, if the effluent gas stream contains fluorine, scrubbing should take place at above room temperature, for example at least 30° C., because oxygen diflouride may be generated at temperatures around room temperature and below. Oxygen diflouride is far more toxic than fluorine. Accordingly, the control 50 restricts the amount of liquid entering the pump so that the liquid temperature is maintained at a predetermined temperature, preferably from 35° C. to 80° C., for example 60° C., so that hydrogen fluoride is preferentially produced over oxygen diflouride. This is preferential because hydrogen fluoride is less toxic than fluorine and oxygen difluoride and can readily be disposed of. Restriction of the amount of liquid in/delivered to the pump has the further advantage that there is less service liquid that requires abatement.

Figure 6:
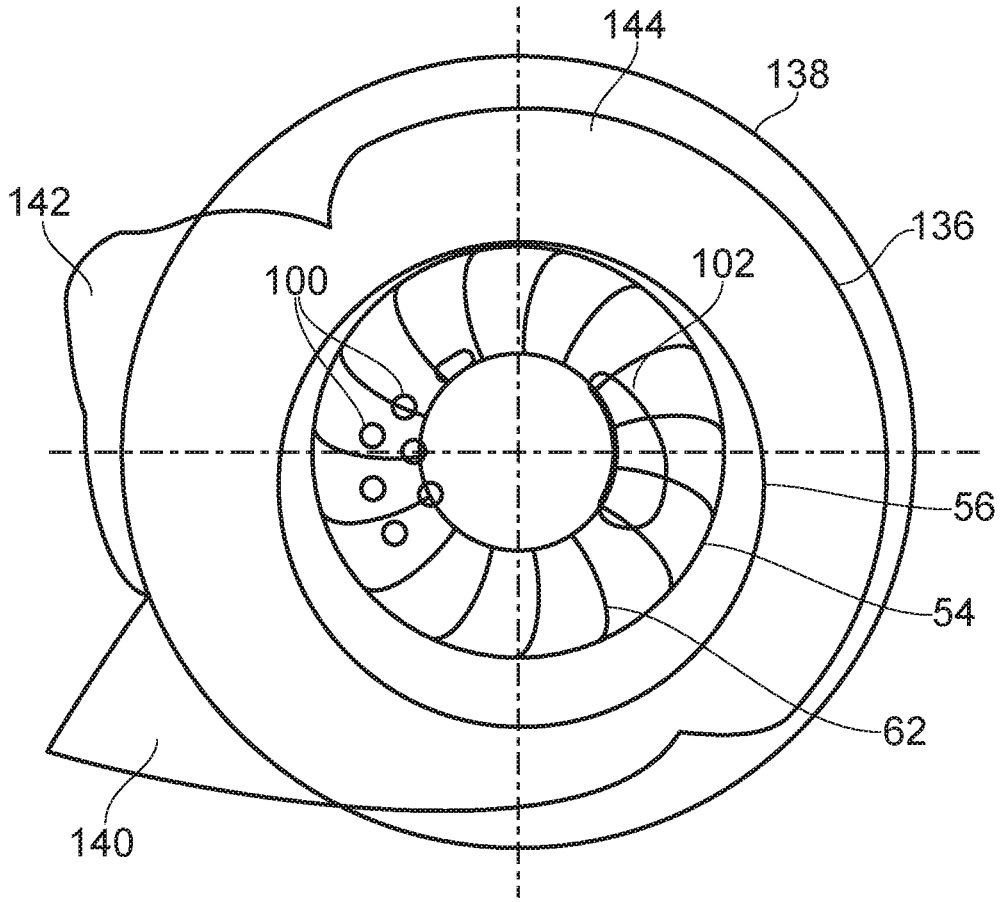
FIG. 6 is an illustration of the distribution of liquid pressure in a liquid ring pump.

A modification of the liquid ring pump (LRP) 32 will now be described with reference to FIGS. 6 and 7. LRPs rely on the service liquid acting as a seal between static and dynamic parts of the pump. The pressure distribution of the liquid within the ring is irregular. FIG. 6 shows a view similar to FIG. 4 overlaid by a typical liquid pressure distribution 136 measured for an unmodified LRP. Line 138 represents atmospheric pressure. Two high pressure lobes occur. One lobe 142 is centred over the outlet apertures 100 and another lobe 140 is located just before the outlet apertures. Low pressure regions occur over the inlet aperture 102 and in the critical region 144 separating the inlet and the outlet. Measurements have shown that ahead of the exhaust port the dynamic liquid pressure is around 2 Bar (absolute), i.e. significantly greater than the pressure required to compress the gas between impeller blades and to push the excess ring liquid and gas through correctly sized exhaust ports. This over compression of the liquid ring is a waste of power.

A previously proposed solution to overcome the problem of over-compression was by adoption of a non-cylindrical pumping chamber. This served to constrain the liquid ring close to the rotor between inlet and outlet ports where no pumping is occurring, yet expand the ring away from the inlet and exhaust ports during that part of the cycle where expansion and compression takes place. However, such a complex stator design is not trivial to manufacture.

Figure 7:
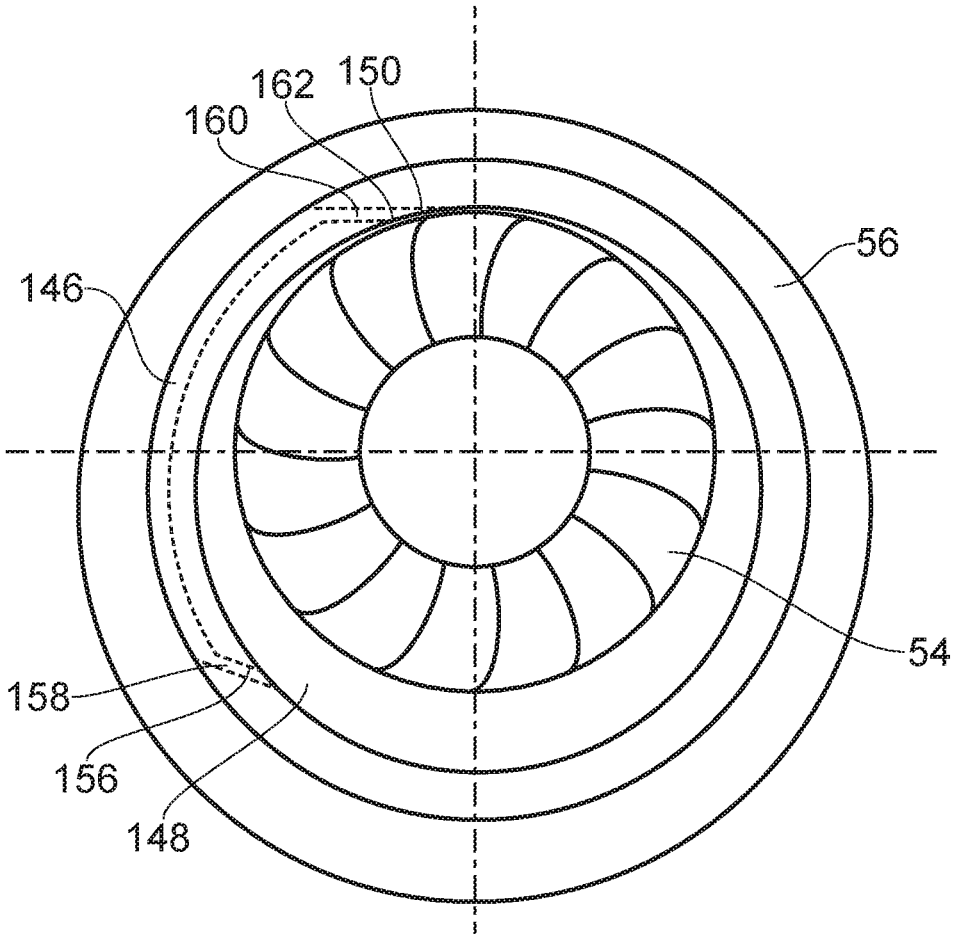
FIG. 7 shows a modification of the liquid ring pump shown in FIG. 3.

The modification according to the embodiment is shown in FIG. 7 in which the stator 56 is arranged to form a conduit between two regions 148, 150 of the pumping chamber 90 for conveying liquid from one region to another region. In this way, the pressure differential between the regions (for example 140 and 144 in FIG. 6) can be reduced and preferably equalised. As shown the stator may comprise a tightly fitting inner sleeve 152 fitted inside a cylindrical outer sleeve 154. The conduit is formed by a groove in the inner sleeve 152 adjacent the outer sleeve 154. A first port 156 opens into the pumping chamber at region 148 and a generally straight bore 158 conveys liquid from the port along the conduit. The bore 158 is angled to the flow of liquid around the ring so that it is generally aligned with a tangent to the ring so that fluid can readily flow into the conduit. A second bore 160 conveys liquid along the conduit to a second port 162 which opens into the second region of the pumping chamber. The bore 158 is angled to the flow of liquid around the ring so that it is generally aligned with a tangent to the ring so that liquid entering the pumping chamber does not disrupt the flow of liquid around the ring. In use, liquid is ported from the high pressure region 148 ahead of the exhaust port, via the conduit feeding the liquid ring between at region 150 between the inlet and exhaust ports. The selected angle of the bores 156, 160 aids the acceleration and filling of the liquid ring as it approaches and passes the upper vertex of the pump casing reducing the leakage of gas which occur in this region.

Figure 8A:
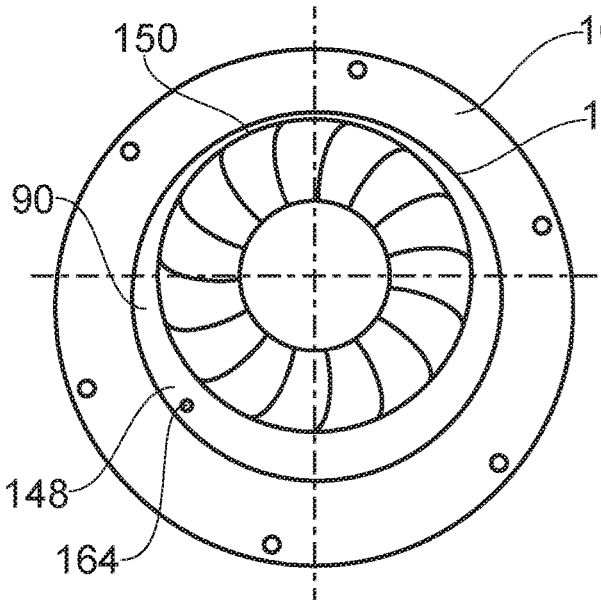
FIGS. 8*a* and 8*b* show an alternative modification of the liquid ring pump shown in FIG. 3.
Figure 8B:
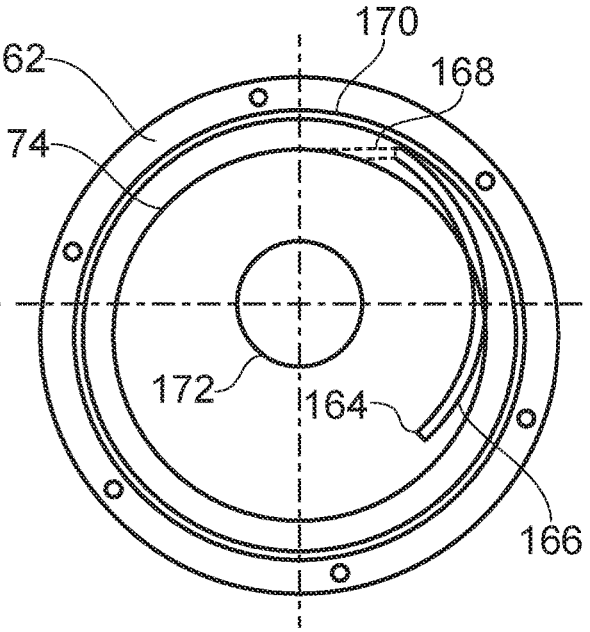

An alternative arrangement to that shown in FIG. 7 is shown in FIGS. 8*a* and 8*b*. The Figures shows a view of each side of a plate 162 forming one axial end of the pumping chamber 90. The plate may for example be the port plate 82 or the adapter plate 88. FIG. 8*a* is a view of the pumping chamber side of the plate and FIG. 8*b* is a view of the rear side of the plate away from the pumping chamber. A port 164 is formed in the front face of the plate which opens into a groove 166 formed in the rear face of plate 162. A second plate (not shown) is fixed to rear of the plate 162 closing the channel and forming a conduit for conveying liquid. Liquid conveyed along the channel 166 enters bore 168 and is conveyed into the pumping chamber 90 through port 170. Accordingly, liquid is conveyed from the high pressure region 148 before the exhaust ports and into the liquid ring at a region 150 proximate the upper vertex of the pump body. The channel directs the high pressure liquid flow which is tangentially re-injected into the liquid ring. For clarity the drive shaft hole 172 and a circle 174 which defines the outer radial extent of the pumping chamber 90 are shown. Careful positioning of the high pressure relief hole 168 within the compression cycle and its distance from the impeller axis allows the diversion of liquid flow to be optimised according to the duty cycle and compression ratio of the liquid ring pump.

In FIGS. 6 to 8, the sizing of the conduits must be selected to ensure that the liquid ring is not over-drained but that sufficient liquid is diverted to aid the sealing of the impeller and stator. The sizing of the conduit could be dynamically controlled using a valve mechanism (located internally or externally) such that the liquid flow could be tailored to the operating conditions.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A liquid ring pump (32) for treating a corrosive effluent gas stream from a processing chamber (10) which is reactive with, or soluble in, a service liquid of the pump to form corrosion products, the pump comprising:

an annular pumping chamber (56, 90) which is cylindrical around a central pumping chamber axis for receiving the gas stream and a service liquid;

a rotor (54) having a rotor axis (58) which is offset from the central pumping chamber axis, the rotor having a plurality of rotor blades which, on rotation of the rotor, cause liquid in the pumping chamber to form a ring having a center coincident with the central axis of the pumping chamber and compression of effluent gas conveyed from an inlet to an outlet of the pumping chamber;

wherein the liquid ring pump comprises a drive chamber (92) in fluid communication with the pumping chamber allowing circulation of the service liquid in the drive chamber and the pumping chamber, and wherein the pumping chamber, drive chamber, magnetic follower and rotor comprise one or more materials which are resistant to the effluent gas stream and the corrosion products generated when the gas stream is treated by the service liquid and wherein the pump comprises a magnetic drive assembly for driving the rotor, the magnetic drive assembly comprising a magnetic follower (74) received in the drive chamber configured to be magnetically coupled with a magnetic drive outside the drive chamber such that when the magnetic drive is driven by a motor the magnetic follower imparts rotation to the rotor and wherein the magnetic follower (74) is fixed relative to the rotor (54) and the axial alignment of the magnetic drive and magnetic follower is arranged so that in use the magnetic drive imparts an axial thrust on the magnetic follower causing the rotor to cooperate with a thrust plate (104) for setting the axial alignment of the rotor in the pumping chamber.

2. A liquid ring pump as claimed in claim 1, wherein the rotor and the follower are supported for rotation by an axial shaft having a center aligned with the offset axis of the rotor, and the axial shaft (78) is made from a corrosion resistant material.

3. A liquid ring pump as claimed in claim 2, wherein service liquid entering the pump is conveyed between the axial shaft (78), and the rotor or the magnetic follower for lubricating and flushing the external surface of the axial shaft.

4. A liquid ring pump as claimed in claim 3, wherein one of the axial shaft (78) and the magnetic follower (74) or the rotor comprises an axially extending channel for conveying service liquid along the axial shaft.

5. A liquid ring pump as claimed in claim 2, wherein the magnetic follower (74) and the rotor comprise respective bearings for bearing against the axial shaft.

6. A liquid ring pump as claimed in claim 3, wherein the rotor (54) comprises a bearing surface for co-operating with the thrust plate (104) and service liquid entering the pump is conveyed between the bearing surface and the thrust plate forming a non-contact hydrodynamic axial bearing.

7. A liquid ring pump as claimed in claim 6, wherein the bearing surface comprises a plurality of generally radially extending channels (106, 110) for conveying service liquid across the bearing surface and forming said hydrodynamic axial bearing.

8. A liquid ring pump as claimed in claim 1, wherein a radially outer portion of the drive chamber comprises a drain port (96) through which service liquid can be drained from the pump for treatment or disposal, and wherein rotation of the magnetic follower in the drive chamber forms a liquid ring around a radially outer periphery of the drive chamber which imparts a hydrodynamic force on the service liquid through the drain port.

9. A liquid ring pump as claimed in claim 1, comprising a conduit having ends formed by first and second ports opening into the pumping chamber for conveying liquid in the liquid ring from a high pressure region to a low pressure region of the pumping chamber.

10. A liquid ring pump as claimed in claim 9, wherein an end portion of the conduit is generally aligned with a tangent to the liquid ring to increase liquid flow into the conduit and/or allow liquid to flow out of the conduit along a tangent to the liquid ring.

11. An apparatus for treating a corrosive effluent gas stream from a processing chamber, comprising:

a pumping arrangement comprising a liquid ring pump according to claim 1 for treating the effluent gas stream;

wherein said pumping chamber receives the effluent gas stream from the processing chamber and a service liquid from a source of service liquid.

12. An apparatus as claimed in claim 11, wherein the liquid ring pump comprises an inlet for receiving the service liquid and an outlet for draining service liquid containing corrosive products, and a liquid control is configured to control the rate at which liquid enters the pump from a source of service liquid dependent on the constituents of the effluent gas flow and the service liquid.

13. An apparatus as claimed in claim 12, wherein the liquid control is configured to control the rate at which liquid enters the pump from a source of service liquid dependent on the solubility or reactivity of the constituents of the effluent gas with the service liquid.

14. An apparatus as claimed in claim 11, wherein the effluent gas stream contains fluorine and the service liquid is water and the control is configured to control the rate at which liquid enters the pump from a source of service liquid to ensure that temperature of the service liquid within the pump is maintained above a predetermined temperature.

15. An apparatus as claimed in claim 11, wherein the liquid ring pump is arranged generally vertically and the inlet to the pump extends in a vertical orientation so that particulates in the effluent gas stream fall under gravity into the pump.

* * * * *